US009986345B2

(12) United States Patent
Kim et al.

(10) Patent No.: US 9,986,345 B2
(45) Date of Patent: May 29, 2018

(54) MOUNTING STRUCTURE OF ELECTRONIC DEVICE FOR SHUTTING OFF POWER AND CASE, ELECTRONIC DEVICE THEREOF

(71) Applicant: Samsung Electronics Co., Ltd., Suwon-si, Gyeonggi-do (KR)

(72) Inventors: Myung-Kyu Kim, Seoul (KR); Yong Seok Bang, Yongin-si (KR); Cheol-Soo La, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days. days.

(21) Appl. No.: 15/140,938

(22) Filed: Apr. 28, 2016

(65) Prior Publication Data

US 2016/0323681 A1 Nov. 3, 2016

(30) Foreign Application Priority Data

Apr. 28, 2015 (KR) ..... 10-2015-0059796

(51) Int. Cl.
*H04R 25/00* (2006.01)

(52) U.S. Cl.
CPC ..... *H04R 25/00* (2013.01); *H04R 25/556* (2013.01); *H04R 25/602* (2013.01); *H04R 25/65* (2013.01); *H04R 2225/021* (2013.01); *H04R 2225/61* (2013.01); *H04R 2460/03* (2013.01); *H04R 2460/17* (2013.01)

(58) Field of Classification Search
CPC .... H04R 25/556; H04R 25/60; H04R 25/602; H04R 25/65; H04R 2225/021; H04R 2225/31; H04R 2225/61; H04R 2460/03; H04R 2460/17; H04R 1/1025
USPC ..... 381/314, 322, 323, 324, 330, 381
See application file for complete search history.

(56) References Cited

U.S. PATENT DOCUMENTS

| | | | | |
|---|---|---|---|---|
| 7,068,804 | B2 * | 6/2006 | Batting | H04R 25/556 381/323 |
| 8,873,784 | B2 * | 10/2014 | Borregaard | H01M 2/1044 381/322 |
| 2009/0202092 | A1 * | 8/2009 | Ruppert | H01M 2/1044 381/323 |
| 2015/0078561 | A1 | 3/2015 | Brungart | |
| 2015/0078599 | A1 | 3/2015 | Sundberg et al. | |
| 2015/0082919 | A1 | 3/2015 | Higashi et al. | |
| 2015/0086051 | A1 | 3/2015 | Link et al. | |
| 2015/0086054 | A1 | 3/2015 | Michel et al. | |

* cited by examiner

*Primary Examiner* — Huyen D Le
(74) *Attorney, Agent, or Firm* — Jefferson IP Law, LLP

(57) ABSTRACT

An electronic device, a case, and a case mounting structure of the electronic device are provided. The electronic device includes a body and a cover for rotating based on a hinge portion in the body and opening and closing at a specified angle. The case includes a mounting portion for receiving at least part of an electronic device and a pressing projection for protruding outwards from the mounting portion and opening the cover in the electronic device by pressing at least part of the cover of the mounted electronic device. When the electronic device is mounting in the mounting portion and one side of the hinge portion is pressed by the pressing projection, the cover is opened at a specified angle and power of the electronic device is shut off.

18 Claims, 11 Drawing Sheets

MOUNTING STRUCTURE OF ELECTRONIC DEVICE FOR SHUTTING OFF POWER AND CASE, ELECTRONIC DEVICE THEREOF

CROSS-REFERENCE TO RELATED APPLICATION(S)

This application claims the benefit under 35 U.S.C. § 119(a) of a Korean patent application filed on Apr. 28, 2015 in the Korean Intellectual Property Office and assigned Serial number 10-2015-0059796, the entire disclosure of which is hereby incorporated by reference.

TECHNICAL FIELD

The present disclosure relates to an electronic device mounting structure for shutting off power, a case including the same, and the electronic device.

BACKGROUND

Recently, as mobile communication technology advances, a portable electronic device offering not only voice calling, but also various services, has become a necessity in modern life. Such an electronic device can be widely used and may be portable, and accordingly many users can use the electronic device.

When some of the portable electronic devices are not in use, the portable electronic device is put and carried in a separate case. In this case, it is necessary to shut off power of the electronic device.

However, when the electronic device includes a power cutoff device, the electronic device needs a separate mounting space, which does not agree with the slim electronic device. The power cutoff device should be manipulated every time the electronic device is mounted in the case, which can be cumbersome. In addition, every time the electronic device without the power cutoff device is put in the case, it is necessary to detach an internal power source (e.g., a battery) from a main body of the electronic device.

Generally, deaf or hard of hearing users have several difficulties in using the electronic device (e.g., a smart phone) to send and receive voice calls. Hence, the deaf or hard of hearing users use the electronic device with a small electronic device (e.g., a hearing aid) associated with the electronic device put on their ear. A basic structure of the hearing aid includes a microphone, an amplifier (amp), and a receiver. The microphone converts an analog signal to a digital signal and outputs the digital signal to the amplifier. The amplifier converts the amplified sound to an analog signal and outputs the analog signal to the receiver. Thus, the voice signal can be provided to the hard of hearing user. In addition, the hearing aid can include a telecoil or a T-coil which detects an electromagnetic wave generating in the electronic device and outputs a voice signal.

When the hearing aid is not in use, it needs to be put in a separate case because it is too small. In the case, the power is shut down so as to prevent resonance in the case in advance and to avoid unnecessary power consumption.

However, since the electronic device includes the power cutoff device therein for shutting off the power, it does not contribute to compactness of the hearing aid. The power cutoff device needs to be manipulated in the case, which can be cumbersome. Further, when the power cutoff device is not equipped, the hearing aid is put in the case after separating a battery, which can also be cumbersome.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide an electronic device mounting structure for shutting of power, a case including the same, and the electronic device.

Another aspect of the present disclosure is to provide an electronic device mounting structure for shutting off power to contribute to compactness of a product without a separate power cutoff device, a case including the same, and the electronic device.

Another aspect of the present disclosure is to provide an electronic device mounting structure for facilitating manipulation by shutting off power by merely mounting in a case, a case including the same, and the electronic device.

In accordance with an aspect of the present disclosure, an electronic device is provided. The electronic device includes a body, and a cover for rotating based on a hinge portion in the body and opening and closing at a specified angle, wherein, when one side of the hinge portion is pressed, the cover is opened at a specified angle and power of the electronic device is shut off.

In accordance with another aspect of the present disclosure, a case is provided. The case includes a mounting portion for receiving at least part of an electronic device, and a pressing projection for protruding outwards from the mounting portion and opening the cover in the electronic device by pressing at least part of the cover of the mounted electronic device, wherein, when the cover of the electronic device is opened by the pressing projection, power of the electronic device is shut off.

In accordance with another aspect of the present disclosure, a mounting structure mounts an electronic device in a case. The electronic device includes a body and a cover for rotating based on a hinge portion in the body and opening and closing at a specified angle. The case includes a mounting portion for receiving at least part of the electronic device, and a pressing projection for protruding outwards from the mounting portion and opening the cover in the electronic device by pressing at least part of the cover of the electronic device. When the electronic device is mounting in the mounting portion and one side of the hinge portion is pressed by the pressing projection, the cover is opened at a specified angle and power of the electronic device is shut off.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, like reference numerals will be understood to refer to like parts, components and structures.

DETAILED DESCRIPTION

Figure 1A:
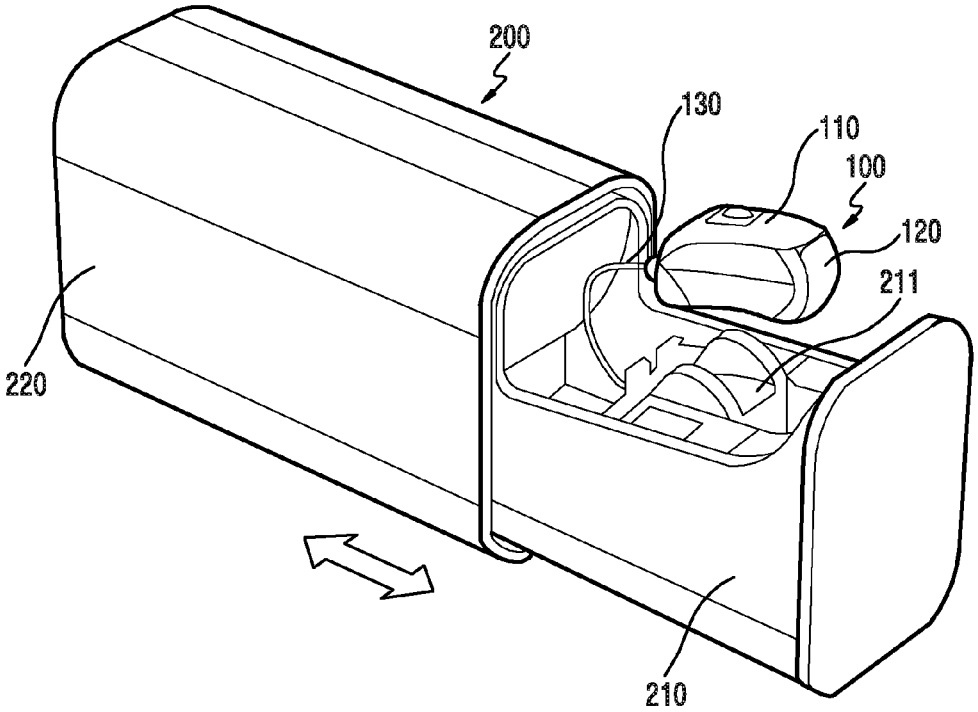
FIG. 1A is a perspective view of a case and an electronic device according to an embodiment of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

An expression "have", "may have", "include" or "may include" or the like used in the present document is intended to indicate a presence of a corresponding characteristic (e.g., a number, a function, an operation, or a constitutional element such as a component), and should be understood that there are additional possibilities of one or more other characteristics.

In the present disclosure, an expression "A or B", "A and/or B", or "one or more of A and/or B" or the like may include all possible combinations of items enumerated together. For example, "A or B", "at least one of A and B", or "at least one of A or B" may indicate all cases where (1) at least one A is included, (2) at least one B is included, and (3) at least one A and at least one B are both included.

Although expressions used in various embodiments of the present disclosure such as "1st", "2nd", "first", "second" or the like may be used to express various constitutional elements, it is not intended to limit an order and/or importance thereof. The above expressions may be used to distinguish one element from another element. For example, a 1st user device and a 2nd user device may indicate different user devices irrespective of an order or importance thereof. For example, a 1st element may be termed a 2nd element, and similarly, the 2nd element may be termed the 1st element without departing from the scope of the present disclosure.

When a certain element (e.g., the 1st element) is mentioned as being "operatively or communicatively coupled with/to" or "connected to" a different element (e.g., the 2nd element), it is to be understood that the certain element is directly coupled with/to another element or can be coupled with/to the different element via another element (e.g., a 3rd constitutional element). On the other hand, when the certain element (e.g., the 1st element) is mentioned as being "directly coupled with/to" or "directly connected to" the different element (e.g., the 2nd element), it may be understood that another element (e.g., the 3rd constitutional element) is not present between the certain element and the different element.

In the case according to which a component is referred to as being "connected to" or "accessed by" another component, it should be understood that not only the component is directly connected to or accessed by the other component, but also there may exist another component between them. Meanwhile, in the case according to which a component is referred to as being "directly connected to" or "directly accessed by" another component, it should be understood that there is no component there between.

Unless defined otherwise, all terms used herein have the same meanings as commonly understood by those skilled in the art. Such terms as those defined in a generally used dictionary are to be interpreted to have the meanings equal to the contextual meanings in the relevant field of art, and are not to be interpreted to have ideal or excessively formal meanings unless clearly defined in the present specification.

An electronic device (e.g., a small electronic device such as a hearing aid or another electronic device functionally connected with a hearing aid for communication (including data communication)) according to various embodiments of the present disclosure can be a device having communication functionality. For example, an electronic device can include at least one of a smartphone, a tablet personal computer (PC), a mobile phone, a video phone, an e-book reader, a desktop PC, a laptop PC, a netbook computer, a personal digital assistant (PDA), a portable multimedia player (PMP), a Moving Picture Experts Group phase 1 or phase 2 (MPEG-1 or MPEG-2) audio layer 3 (MP3) player, a mobile medical appliance, a camera, and a wearable device (e.g., a head-mounted-device (HMD) such as electronic glasses, an electronic textiles, an electronic bracelet, an electronic necklace, an electronic appcessory, an electronic tattoo, and a smart watch).

An electronic device can be a smart home appliance having communication functionality. The smart home appliance can include, for example, at least one of a television, a digital video disc (DVD) player, an audio system, a refrigerator, an air conditioner, a vacuum cleaner, an oven, a microwave oven, a washing machine, an air purifier, a set-top box, a TV box (e.g., Samsung HomeSync™ AppleTV™, or Google TV™), game consoles, an electronic dictionary, a digital key, a camcorder, and a digital frame.

An electronic device can include at least one of various medical appliances (e.g., magnetic resonance angiography (MRA), magnetic resonance imaging (MRI), computed tomography (CT), X-ray system, ultrasonicator), a navigation device, a global positioning system (GPS) receiver, an event data recorder (EDR), a flight data recorder (FDR), an in-vehicle infotainment device, marine electronic equipment (e.g., marine navigation device and gyro compass), avionics, a security device, a vehicle head unit, an industrial or home robot, an automatic teller's machine (ATM) of a financial company, and a point of sale (POS) of a store.

An electronic device can include at least one of part of furniture or building/structure having communication functionality, an electronic board, an electronic signature receiving device, a projector, and various gauges (e.g., gauges for water, electricity, gas, and radio waves). An electronic device can be one or a combination of those various devices. The electronic device can be a flexible device. Those skilled in the art should understand that an electronic device of the present disclosure is not limited to those devices.

Various embodiments of the present disclosure provide an electronic device by referring to the accompanying drawings. The term "user" can indicate a person or a device (e.g., an artificial intelligence electronic device) who or which uses an electronic device.

Figure 1B:
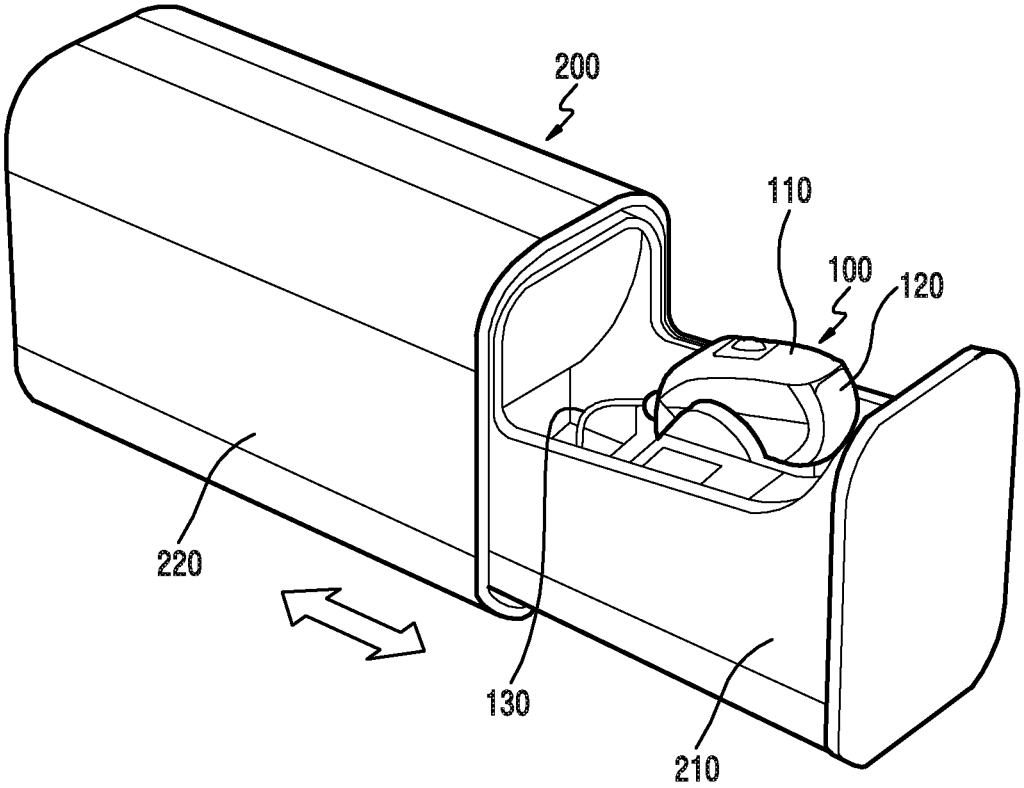
FIG. 1B is a perspective view of an electronic device mounted on a case according to an embodiment of the present disclosure.

FIG. 1A is a perspective view of a case 200 and an electronic device 100 according to an embodiment of the present disclosure. FIG. 1B is a perspective view of an electronic device 100 mounted on a case 200 according to an embodiment of the present disclosure.

Referring to FIG. 1A, the electronic device 100 is a small electronic device for a deaf or hard of hearing user and can include a hearing aid. When the hearing aid is not in use, it can be mounted in a case and then carried.

According to various embodiments of the present disclosure, the case 200 can include an outer case 220 and an inner case 210 which detachably slides into the outer case 220 (e.g., along a plane indicated in FIG. 1A by an arrow). The inner case 210 can be completely separated from the outer case 220 or blocked from completely separating from the outer case 220 after it is opened to a certain degree. When the inner case 210 is completely opened from the outer case 220, it can receive the electronic device 100. When the inner case 210 is fully pushed in, the outer case 220 can be of a portable size.

According to various embodiments of the present disclosure, the inner case 210 can include a body mounting portion 211 exposed to outside. According to an embodiment of the present disclosure, the body mounting portion 211 of the inner case 210 can be constructed to tightly receive at least part of the electronic device 100.

According to various embodiments of the present disclosure, the electronic device 100 can include a body 110 and a cable 130 which is drawn from the body 110 and includes a microphone as an ear piece at its end. According to an embodiment of the present disclosure, the body 110 can include a battery cover 120 which can be opened at a specified angle. The battery cover 120 can be opened at various angles while it is not completely separated from the body 110. The battery cover 120 can receive a battery (e.g., a coin-type battery). When the battery cover 120 is opened from the body 110, power of the electronic device 100 can be cut off.

According to various embodiments of the present disclosure, the battery cover 120 can be opened at a specified angle by merely mounting the electronic device 100 in the body mounting portion 211 of the case 200. According to an embodiment of the present disclosure, the battery cover 120 can be opened at a specified angle to automatically shut down the power by, but not limited to, merely mounting the electronic device 100 in the body mounting portion 211 of the case 200. Without mounting on the case 120, the battery cover 120 can be opened by a user at various angles to shut down the power. When the battery cover 120 of the electronic device 100 is opened at a specified angle, it may lead to replace the battery of the electronic device 100.

According to various embodiments of the present disclosure, the battery cover 120 can be opened at a specified angle by merely mounting the electronic device 100 in the body mounting portion 211 of the case 200, and thus the battery is separated from the electronic device 100 to automatically shut down the power. That is, convenience in use can be enhanced because the user does not need separate manipulation to shut off the power of the electronic device.

Figure 2A:
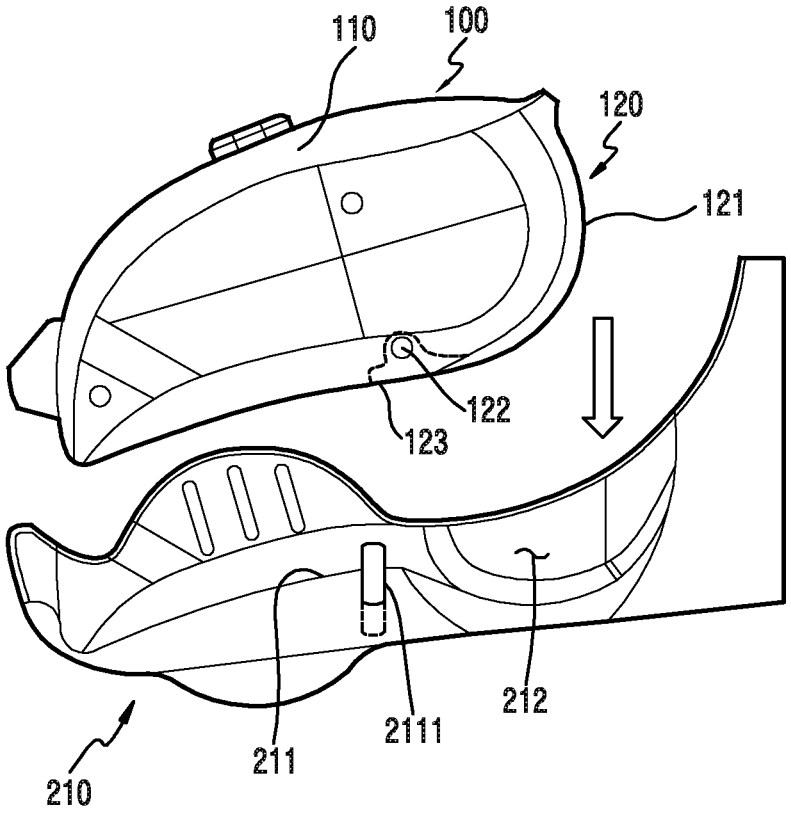
FIG. 2A is a view of an electronic device before mounting on a case according to an embodiment of the present disclosure.

FIG. 2A is a view of an electronic device 100 before mounting on a case 200 according to an embodiment of the present disclosure.

Referring to FIG. 2A, the electronic device 100 can include a body 110 and a battery cover 120 which can be opened at the back of the body 110. The battery cover 120 can include a battery 140 of FIG. 2C. When the battery cover 120 is opened, at least part of the battery can be exposed outside the electronic device 100.

The battery cover 120 can rotate on the body 110. The battery cover 120 can include a hinge portion 122 hinged on the body 110 to rotate, a battery receiving portion 121 extending on one side of the hinge portion 122, and a projection contact portion 123 extending on the other side of the hinge portion 122. When the projection contact portion 123 is pressed toward the body, the battery receiving portion 121 can rotate outwards based on the hinge portion 122 and thus open. When the battery cover 120 receives a coin-type battery as the battery 140, the battery cover 120 may further include a fixing unit for securing at least part of both sides of the coin-type battery.

Figure 2B:
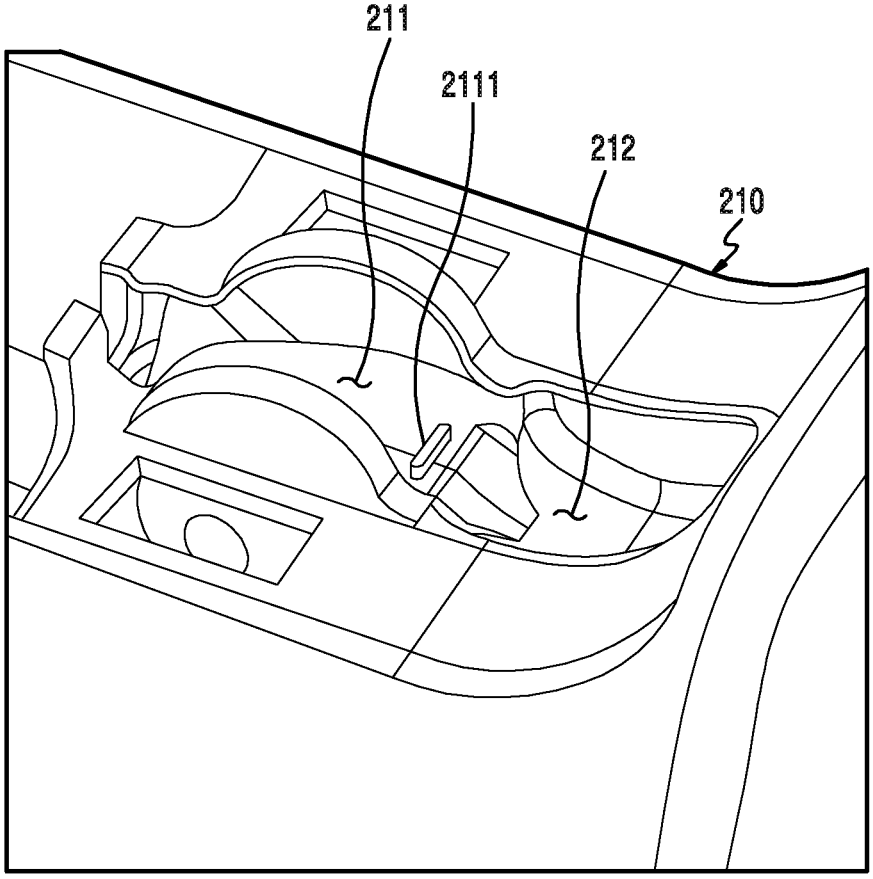
FIG. 2B is a perspective view of an inner case including a body mounting portion for receiving an electronic device according to an embodiment of the present disclosure.

FIG. 2B is a perspective view of an inner case 210 including a body mounting portion 211 for receiving an electronic device 100 according to an embodiment of the present disclosure.

Referring to FIGS. 2A and 2B, the inner case 210 can include a body mounting portion 211 for receiving a body 110 of the electronic device 100. The body mounting portion 211 can be constructed to tightly support at least part of both sides of the electronic device 100. The body mounting portion 211 can further include a cover receiving space 212 for receiving the opening battery cover 120 when the electronic device 100 is mounted on the body mounting portion 211. The cover receiving space 212 can include an enough space for the battery cover 120 opening downwards when the electronic device 100 is mounted on the body mounting portion 211.

The body mounting portion 211 can include a pressing projection 2111 which protrudes upwards to a certain height. When the electronic device 100 is mounted on the body mounting portion 211, the pressing projection 2111 can be disposed at a location corresponding to the projection contact portion 123 of the battery cover 120 of the electronic device 100. The pressing projection 2111 may be formed when the inner case 210 is injection molded, or separately disposed in the body mounting portion 211 of the inner case 210.

Figure 2C:
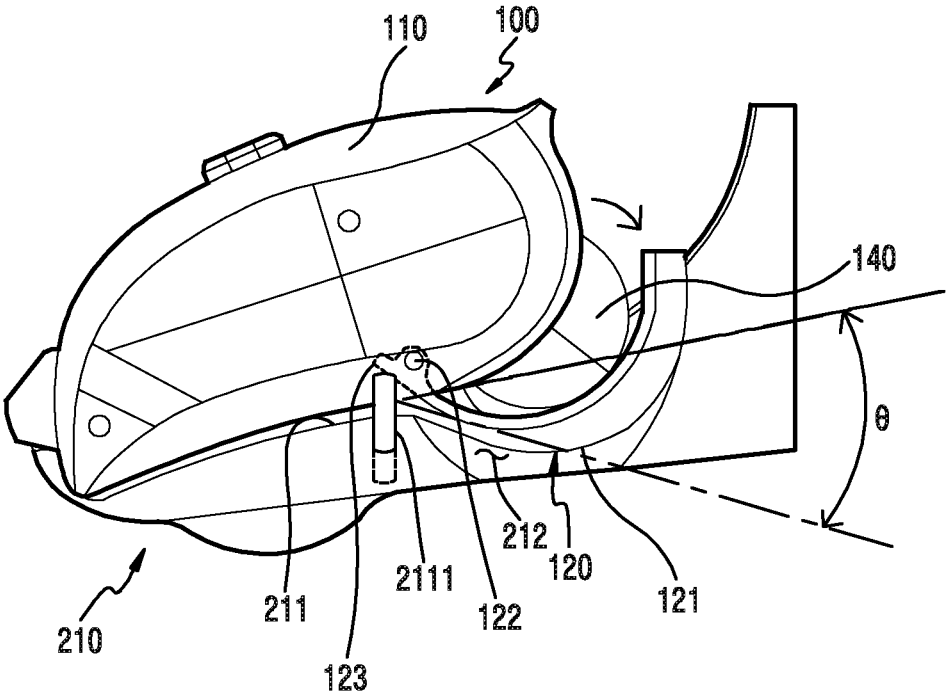
FIG. 2C is a view of an electronic device mounted on an inner case according to an embodiment of the present disclosure.

FIG. 2C is a view of an electronic device 100 mounted on an inner case 210 according to an embodiment of the present disclosure.

Referring to FIG. 2C, when the electronic device 100 is mounted on the body mounting portion of the inner case 210, a projection contact portion of the battery cover can contact a contact projection which protrudes from the body mounting portion. When the electronic device 100 is continuously pressed downwards, the projection contact portion of the battery cover is pushed into the electronic device 100 by the pressing projection of the body mounting portion. In so doing, the battery receiving unit of the battery cover can rotate based on the hinge portion and open outwards from the electronic device 100 at a certain angle θ. The battery receiving unit of the open battery cover can be received in the cover receiving space near the body mounting portion of the inner case.

The opening angle θ of the battery cover is not limited to a specific angle, and the battery cover can be open enough to be received by the cover receiving space. The opening angle θ may range to a specific preset opening angle within a receiving range of the battery receiving space. The opening angle θ of the battery cover can include at least one of, but not limited to, 20 degrees, 35 degrees, 50 degrees, and 65 degrees. The battery cover can open at various angles.

Figure 3:
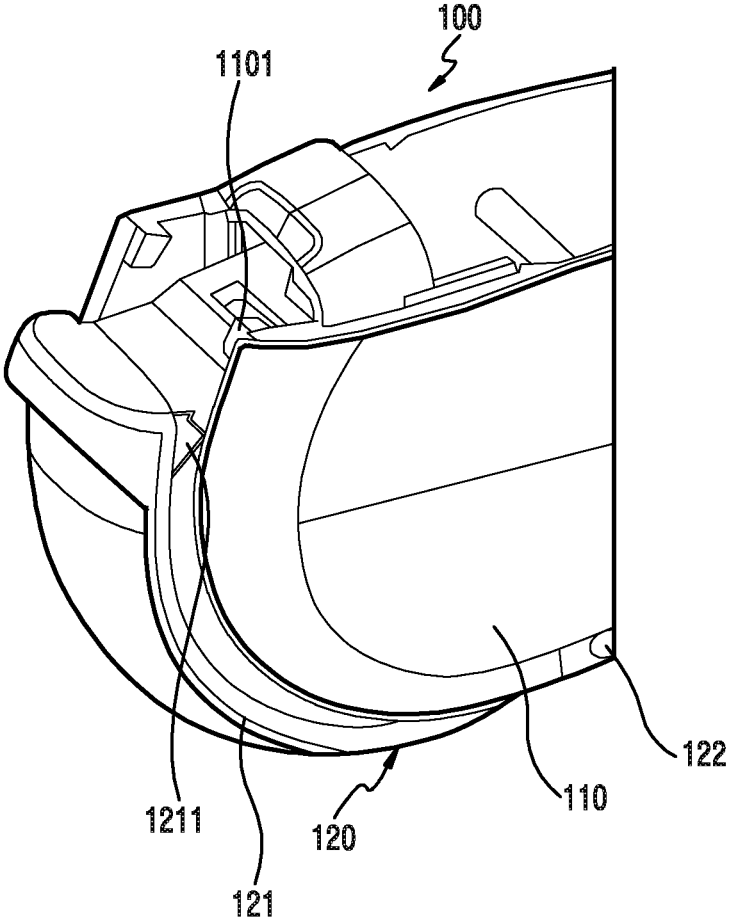
FIG. 3 is a perspective view of a battery cover fixing structure in an electronic device according to an embodiment of the present disclosure.

FIG. 3 is a perspective view of a battery cover fixing structure in an electronic device according to an embodiment of the present disclosure.

Referring to FIG. 3, when a battery cover 120 is open and the electronic device 100 is in use again (e.g., when the electronic device 100 is detached from an inner case), a user can close the battery cover 120 back to an initial state in the electronic device 100. In this case, the battery cover 120 can include a mounting structure for retaining the closed state of the battery cover 120 when the battery cover 120 is closed in the electronic device 100. At least one fixing projection 1101 can protrude in an inner side of the body 110 on which the battery cover 120 of the electronic device 100 rotates, and the battery cover 120 can include a fixing groove 1211 to which the fixing projection 1101 is inserted. When the battery cover 120 is mounted to the electronic device 100, its location can be maintained such that the fixing groove 1211 is tightly coupled with the fixing projection 1101 of the body 110. However, a holding force for coupling the fixing projection 1101 with the fixing groove 1211 can be weaker than a force where, when the electronic device 100 is mounted in the body mounting portion 211, the pressing projection 2111 presses the projection contact portion 123 of the battery cover 120 and tries to open based on the hinge portion 122.

Hence, when the electronic device 100 is mounted in the body mounting portion 211 of the inner case 210, the battery cover 120 can open based on the hinge portion 122. When the electronic device 100 is in use and the battery cover 120 is closed in the electronic device 100, the battery cover 120 is not opened outwards by its weight.

Instead of the coupling structure of the fixing groove 1211 and the fixing projection 1101, an elastic member can be used to keep the battery cover 120 closed in the electronic device 100 all the time. For example, a torsion spring may be disposed based on a hinge axis of the hinge portion 122, and the battery cover 120 may be automatically closed by an elastic force of the torsion spring in the electronic device 100 by merely detaching from the inner case 210.

Figure 4:
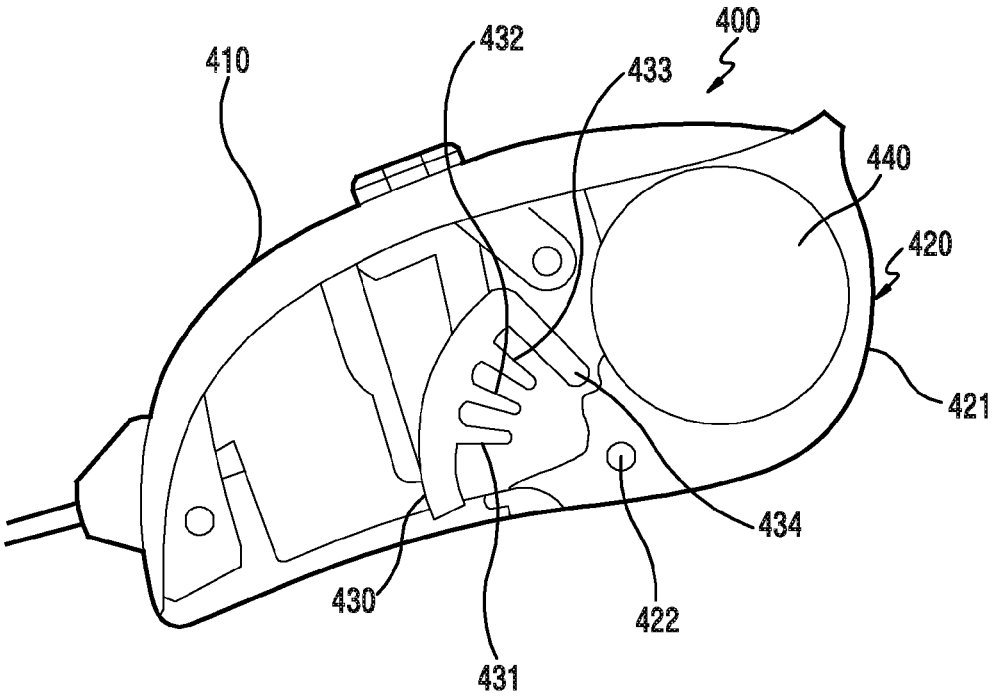
FIG. 4 is a diagram of an electronic device including a stopper for regulating an opening angle of a battery cover according to an embodiment of the present disclosure.

FIG. 4 is a view of an electronic device 400 including a stopper 430 for regulating an opening angle of a battery cover 420 according to an embodiment of the present disclosure.

Referring to FIG. 4, the electronic device 400 can include a body 410 and a battery cover 420 which can open at the back of the body 410. The battery cover 420 can include a battery 440. At least part of the battery 440 can be exposed outside the electronic device 400 when the battery cover 420 is opened.

The battery cover 420 can rotate on the body 410. The battery cover 420 can include a hinge portion 422 hinged on the body 410 to rotate, a battery receiving portion 421 extending on one side of the hinge portion 422, and a projection contact portion 423 extending on the other side of the hinge portion 422.

When the electronic device 400 is mounted in the body mounting portion 211 of the inner case 210 and the pressing projection 2111 presses the projection contact portion 423 toward the body, the battery receiving portion 421 can rotate outwards based on the hinge portion 422 and thus open. When the battery cover 420 receives a coin-type battery as the battery 440, the battery cover 420 can further include a fixing unit for securing at least part of both sides of the coin-type battery.

The battery cover 420 may be opened in order to replace the battery 440 or to arbitrarily cut the power of the electronic device 400, not just to mount the electronic device 400 in the case. A stopper 430 can be disposed within a rotation range of the projection contact portion 423. The stopper 430 can include a plurality of locking projections 431 through 434 at regular intervals. The battery cover 420 can open at various angles depending on positions where the projection contact portion 423 is blocked by the locking projections 431 through 434, and maintain the opening angle.

FIGS. 5A to 5D depict operations of a battery cover 420 which is held open by a stopper 430 of FIG. 4 at various angles according to an embodiment of the present disclosure.

Figure 5A:
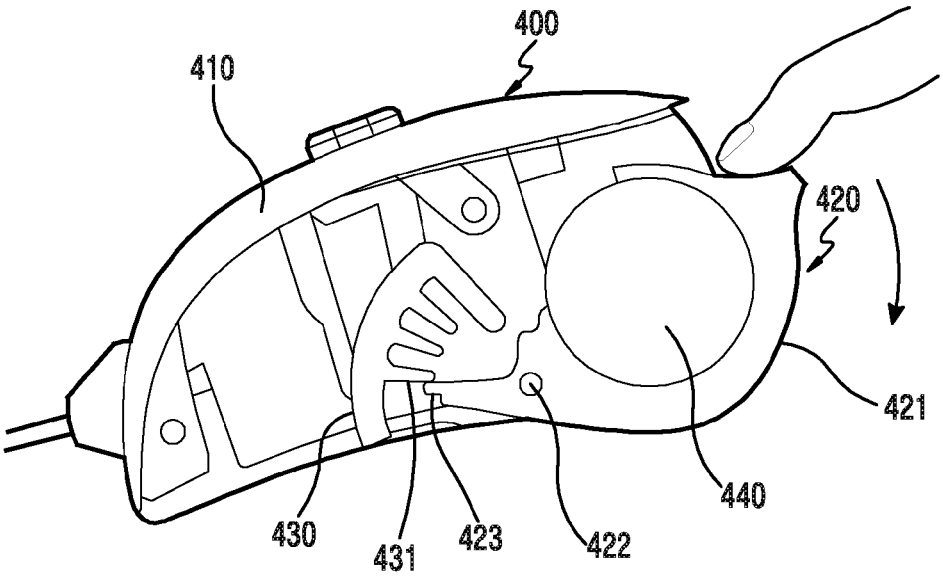
FIGS. 5A to 5D are views of a battery cover which is opened by a stopper of FIG. 4 at various angles according to an embodiment of the present disclosure.

Referring to FIG. 5A, the projection contact portion 423 is caught by the first locking projection 431, and thus the battery cover 420 is opened at 20 degrees.

Figure 5B:
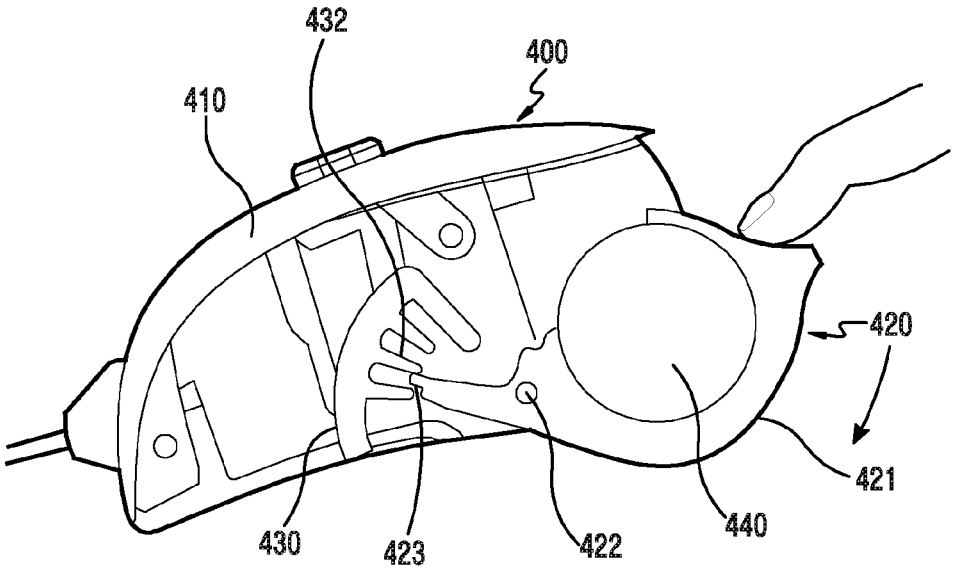

Referring to FIG. 5B, the projection contact portion 423 is caught by the second locking projection 432, and thus the battery cover 420 is opened at 35 degrees. In this case, the projection contact portion 423 of the battery cover 420 climbs over the first locking projection 431 and is caught by the second locking projection 432. The projection contact portion 423 can maintain its location (the battery cover opening angle at 35 degrees) between the first locking projection 431 and the second locking projection 432.

Figure 5C:
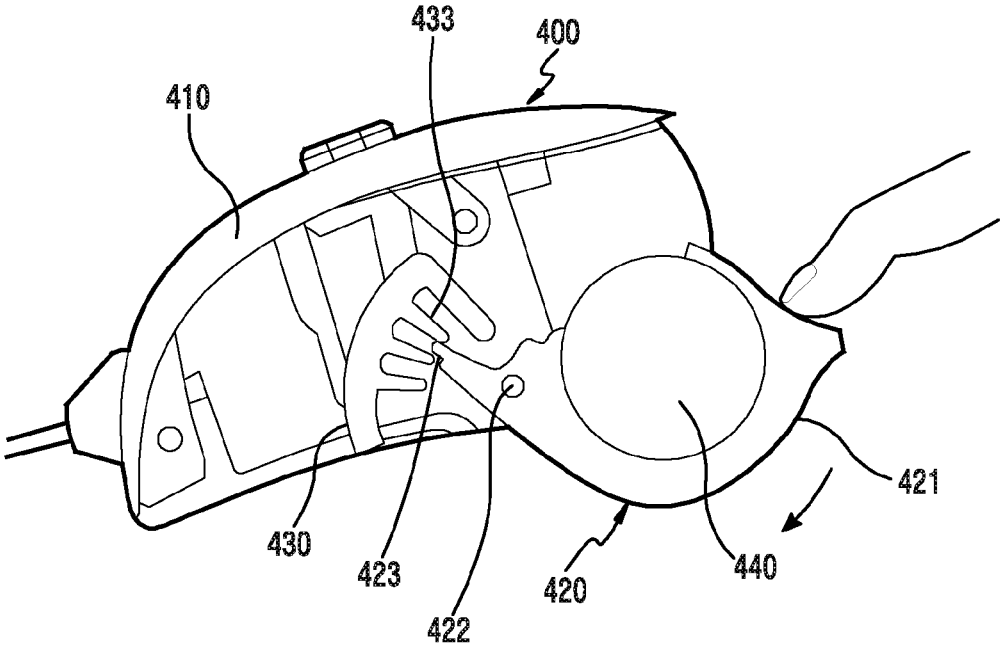

Referring to FIG. 5C, the projection contact portion 423 is caught by the third locking projection 433, and thus the battery cover 420 is opened at 50 degrees. In this case, the projection contact portion 423 of the battery cover 420 climbs over the second locking projection 432 and is caught by the third locking projection 433. The projection contact portion 423 can maintain its location (the battery cover opening angle at 50 degrees) between the second locking projection 432 and the third locking projection 433.

Figure 5D:
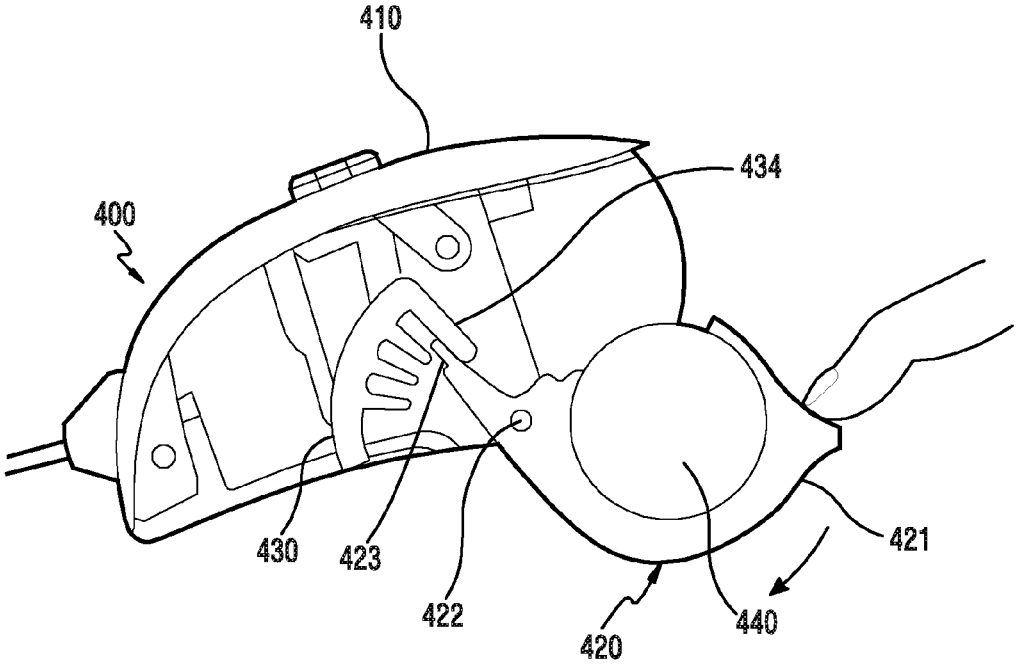

Referring to FIG. 5D, the projection contact portion 423 is caught by the fourth locking projection 434, and thus the battery cover 420 is opened at 65 degrees. In this case, the projection contact portion 423 of the battery cover 420 climbs over the third locking projection 433 and is caught by the fourth locking projection 434. The projection contact portion 423 can maintain its location (e.g., the battery cover opening angle at 65 degrees) between the third locking projection 433 and the fourth locking projection 434.

As set forth above, the electronic device, which does not include a power shutdown device, can contribute to product compactness and facilitate manipulation with the power cutoff by merely mounting and keeping the electronic device in the case.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An electronic device comprising:

a body; and a cover for rotating based on a hinge portion in the body and opening and closing at a specified angle, wherein, when the electronic device is mounted in a case for portability, one side of the hinge portion is pressed by at least a portion of the case and the cover is opened at the specified angle and power of the electronic device is shut off.

2. The electronic device of claim 1, wherein the cover receives a battery of the electronic device, and the battery moves together with the cover when the cover opens.

3. The electronic device of claim 1, wherein the cover comprises:

the hinge portion for rotating based on a hinge axis in the body;

a battery receiving portion for extending to one side of the hinge portion and supporting a battery received in the electronic device; and a projection contact portion for extending to the other side of the hinge portion and opening the battery receiving portion based on the hinge portion according to external pressure.

4. The electronic device of claim 3, wherein a cover rotating space of the body includes at least one fixing projection, and a fixing groove is formed at a corresponding location of the cover to receive the fixing projection in a press fit manner so as to keep the cover closed in the body.

5. The electronic device of claim 3, further comprising:

a stopper disposed in a rotation range of the projection contact portion in the body, wherein the projection contact portion is selectively caught by the stopper and an opening angle of the cover is regulated.

6. The electronic device of claim 5, wherein the stopper comprises:

a plurality of locking projections at regular intervals within the rotation range of the projection contact portion, wherein any one of the locking projections locks and regulates the opening angle of the cover.

7. The electronic device of claim 1, wherein the case comprises:

a mounting portion for receiving at least part of the electronic device, wherein the mounting portion further comprises:

a pressing projection for protruding outwards at a location corresponding to the one side of the hinge portion, and when the electronic device is mounted in the mounting portion, the pressing projection presses the one side of the hinge portion.

8. The electronic device of claim 7, further comprising:

a cover receiving space for receiving the cover opened by the pressing projection on one side of the mounting portion.

9. The electronic device of claim 1, wherein the electronic device is a portable hearing aid.

10. A case comprising:

a mounting portion for receiving at least part of an electronic device for portability; and a pressing projection for protruding outwards from the mounting portion and opening a cover of the mounted electronic device by pressing at least part of the cover of the mounted electronic device, wherein, when the cover of the mounted electronic device is opened by the pressing projection, power of the mounted electronic device is shut off, wherein the cover comprises:

a hinge portion for rotating based on a hinge axis in a body;

a battery receiving portion for extending to one side of the hinge portion and supporting a battery received in the mounted electronic device; and a projection contact portion for extending to another side of the hinge portion and opening the battery receiving portion based on the hinge portion according to external pressure, and wherein the pressing projection presses the projection contact portion and opens the battery receiving portion based on a rotation axis of the hinge portion in the mounted electronic device.

11. The case of claim 10, wherein the cover receives a battery of the mounted electronic device, and the battery moves together with the cover when the cover opens.

12. The case of claim 11, further comprising:

a cover receiving space for receiving the cover of the mounted electronic device opened by the pressing projection on one side of the mounting portion.

13. The case of claim 10, wherein the mounted electronic device is a portable hearing aid, and the case is a portable case for receiving the portable hearing aid.

14. A mounting structure for mounting an electronic device in a case, the electronic device comprising:

a body; and a cover for rotating based on a hinge portion in the body and opening and closing at a specified angle, and the case comprising:

a mounting portion for receiving at least part of the electronic device; and a pressing projection for protruding outwards from the mounting portion and opening the cover of the electronic device by pressing at least part of the cover of the electronic device, wherein, when the electronic device is mounted in the mounting portion and one side of the hinge portion is pressed by the pressing projection, the cover is opened at a specified angle and power of the electronic device is shut off.

15. The mounting structure of claim 14, wherein the cover comprises:

the hinge portion for rotating based on a hinge axis in the body;

a battery receiving portion for extending to one side of the hinge portion and supporting a battery received in the electronic device; and a projection contact portion for extending to the other side of the hinge portion and opening the battery receiving portion based on the hinge portion according to external pressure, wherein the pressing projection presses the projection contact portion and opens the battery receiving portion based on a rotation axis of the hinge portion in the electronic device.

16. The mounting structure of claim 14, wherein the cover receives a battery of the electronic device, and the battery moves together with the cover when the cover opens.

17. The mounting structure of claim 14, further comprising:

a cover receiving space for receiving the cover of the electronic device opened by the pressing projection on one side of the mounting portion.

18. The mounting structure of claim 14, wherein the electronic device is a portable hearing aid, and the case is a portable case for receiving the portable hearing aid.

* * * * *